United States Patent [19]

Kies

[11] 4,148,545

[45] Apr. 10, 1979

[54] CONNECTION ELEMENT FOR ELECTRIC CABLE CONNECTIONS

[75] Inventor: Walter Kies, Ditzingen, Fed. Rep. of Germany

[73] Assignee: Eckardt AG, Fed. Rep. of Germany

[21] Appl. No.: 793,248

[22] Filed: Jun. 3, 1977

[30] Foreign Application Priority Data

May 18, 1976 [DE] Fed. Rep. of Germany ..... 2621978

[51] Int. Cl.[2] ..... H01R 13/64

[52] U.S. Cl. ..... 339/184 M; 339/186 M

[58] Field of Search ..... 339/31, 184, 185 R, 339/185 RL, 186 R, 186 M, 191 A

[56] References Cited

U.S. PATENT DOCUMENTS

| | | | |
|---|---|---|---|
| 1,417,928 | 3/1947 | Guernesy | 339/31 M |
| 2,750,572 | 6/1956 | Fox | 339/185 R |
| 2,888,660 | 5/1959 | Fox | 339/185 R |
| 3,656,086 | 4/1972 | Debaigt | 339/186 M |

FOREIGN PATENT DOCUMENTS

| | | | |
|---|---|---|---|
| 2259231 | 6/1974 | Fed. Rep. of Germany | 339/184 M |
| 630333 | 10/1949 | United Kingdom | 339/184 M |
| 779946 | 7/1957 | United Kingdom | 339/185 R |

*Primary Examiner*—Roy Lake
*Assistant Examiner*—E. F. Desmond
*Attorney, Agent, or Firm*—Craig & Antonelli

[57] ABSTRACT

A connection plug element is provided as a plurality of contact plates being supported in a frame structure. The frame structure includes a plurality of slotted insertion passages for the contact plates which extend into the frame to a midpoint stop zone. The slotted grooves allow coding of the contact plates in a manner to be associated with a socket connection having corresponding socket openings. The plug element is useful in installations of instruments and switching panels.

12 Claims, 8 Drawing Figures

CONNECTION ELEMENT FOR ELECTRIC CABLE CONNECTIONS

The invention relates to a connection plug element for electric cable connections or connectors, especially for switch boxes or the like, in which a plurality of contact plates or male connector members is disposed in a holding device and connectable to connecting members, such as socket connectors.

For switchboard assembly, elements that can be built-in, in the form of multiple contact plugs of pins or the like, are known where the flat contact plates are embedded in an insulating housing. There are different forms for various uses which, as required, can be selected from mass-produced parts, or specially manufactured. Since it is still customary in connection techniques to use switch elements that cannot be confused, particularly in switchboard construction where several thousands of different connections must be established, these prefabricated elements cannot just be simply installed, especially if coded connections are wanted. For this reason, it has been customary thus far to have connections made by hand according to plan, and as a rule this even has to be done twice, once for checking by an inspector before delivery, and again before it is put into operation.

Therefore, the problem to which the present invention is addressed is to produce a connection element that allows variation in the kind of plug connection, and therewith coding of the plug connection, yet is suitable also for use for other kinds of connectors, both single and multiple, and for construction of connection places of instruments, as well as for incorporation in switchboard panels in the form of contact strips or the like.

The invention resides in a construction where a holding device is made as a frame with insert passages for the contact plates or male connector members, and where the contact plates or male connection pins are held in the insert passages at a stop zone at the middle of the contact plates. This arrangement allows association of only a desired number of contact plates with the respective frame, so that different connection possibilities can be established upon assembly. It is advantageous if the frame has an edge on one side that extends around the contact plates, and if the contact plates are thrust in from a side that is away from this surrounding edge. Another variation for multiplication of connection possibilities can be achieved by the contact plates being made in symmetrical flat plates with reference to a midplane, and having a stop zone extending half-way into the insertion passages of the frame. In such an arrangement, it is possible to join two frames in a mirror-image assembly with the result that there is an enclosed insulated connection plug element.

The insertion passages for the contact plates in the frame can advantageously be made with double slit passages, including paired grooves that are mutually associated and perpendicular to each other. This enables selective introduction into one or the other of the grooved passages of the contact plates. By this means, an increase in the number of possible connections per frame is provided which cannot be confused with one another, since part of the plate or male connector plug is thrust-in in one direction, and the other part is thrust-in in another direction into the insertion passage. If analogously built socket connectors are associated with such elements, there is readily developed a very large number of connection possibilities that cannot be confused, and no soldering work is required. The connection is easily effected by plugging-in the plug-in parts, and easy reproduction of the connections can be provided both before delivery and when they are put to use.

Other known kinds of connections for the contact plate connectors can also be provided. For example, only one side could be used for plugging-in, while the other side could be provided with soldered or "wire-wrap" cable connections. In all cases, codability is preserved.

The double slit passages can be disposed in the frame in matrices with rows adjacent to each other, and/or in columns one below the other, in which case it has been found to be advantageous if there are three double slit passages adjacent and below each other.

Finally, the frames themselves can be made into structural units, combined in rows adjacent to each other or one below the other, where their disposition in racks or even on the back wall of instruments can be advantageously utilized. For these embodiments, plug-in socket parts can be, in turn, combined as units, so that the connecting work is simplified even more.

The advantages, features, and aspects of the present invention may be seen by reference to the drawing figures which provide for purposes of illustration only several embodiments of the present invention, and wherein.

Figure 2:
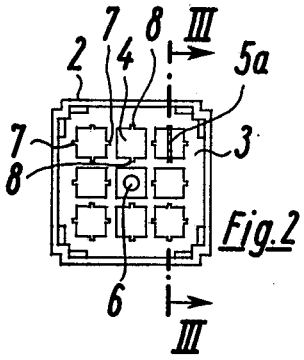
FIG. 2 is a view of FIG. 1 in the direction of arrow II.
Figure 3:
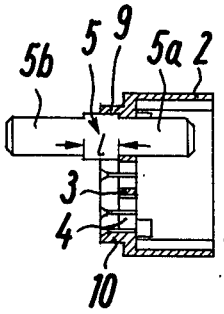
FIG. 3 is a section through a holding frame of the connection element of FIGS. 1 and 2, in the direction of line III—III of FIG. 2, and with the contact plate in place.
Figure 4:
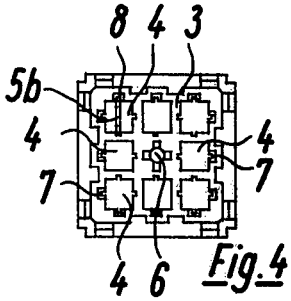
FIG. 4 is a view of a part of FIG. 1, as seen in the direction of arrow IV.
Figure 1:
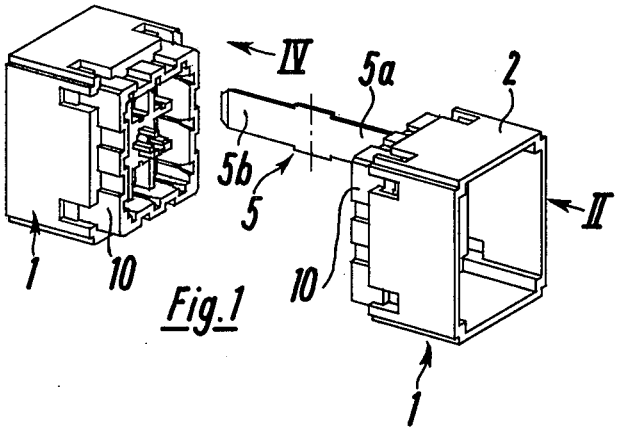
FIG. 1 shows an exploded, perspective view of a connection element according to the present invention with the individual parts before assembly.

FIGS. 1 to 4 show the plug elements of the present invention with frame like parts 1, made of plastic, which have wall 2 around a cavity open on one side and closed on the other by a partition 3, and has a plurality of insertion passages 4 for mounting of a half portion 5*a* of one or more symmetrically constructed flat contact plates or pins 5 into the frame parts 1. As FIGS. 2 and 4 show, three insertion passages 4 are disposed next to each other and three insertion passages 4 are arranged one below the other in a matrix, so that they can be enclosed in a square periphery. The separation of the individual insertion passages 4 with respect to each other is the same or equivalent; and there are eight passage openings 4 disposed about a central passage opening 6 through which, as will be described later, a central connecting screw can be thrust, such that two identically constructed frames 1 can be joined to each other, as in FIG. 5.

Each of the insertion passages 4 has a double slit passage which consists of two slit passages that are perpendicular to each other, formed respectively by a pair of grooves 7 and 8 which are perpendicular to each other. As FIG. 2 shows, grooves 8 are of such dimensions that the open distance between two opposedly placed grooves 8 of a passage 4 corresponds precisely to the width of part 5*a* or 5*b* of contact plate or male connector member 5. Therefore, part 5*a* can be thrust into grooves 8 from the left side of frame 1 (as seen in FIG. 3) until stop shoulder 9 of contact plate 5 abuts against wall 3. Wall 10 of frame part 1 projecting toward the left from wall 3 has exactly half the length L of the middle part of contact plate 5. Part 5*b* of contact plate 5 is a mirror image of part 5*a* as measured to the midplane of plate 5, which passes through the connecting plane of wall 10 in FIG. 3.

In frame 1, there may be as many as eight contact plats 5 thrust-in with the possibility, in the upper row of insertion passages 4, of either inserted contact plates that stand upright, as shown, in grooves 8, or horizontally in grooves 7. There is the same possibility in the lower row of insertion passages 4, while the two middle openings 4, to the left and right of hole 6, can have horizontally disposed contact plates. Accordingly, selection possibilities are made available which are adequate for mutual connections of plug parts without confusion. It is also possible to provide the two middle openings 4 with supplementary grooves 8.

Figure 5:
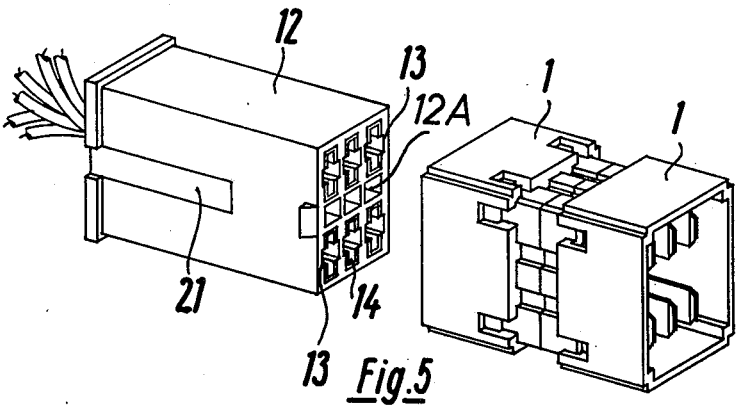
FIG. 5 is a perspective view of the assembled element of FIG. 1 with an associated socket plug-in part.
Figure 6:
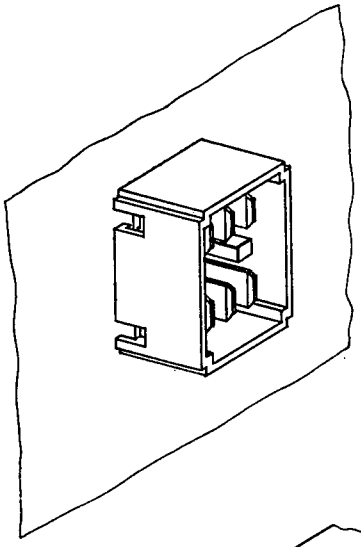
FIG. 6 shows the use of a connection element in accordance with the present invention as a connnector at the back wall of an instrument.

In FIG. 6, the frame parts of FIGS. 2 to 4 can be introduced for plug connections on the back wall of an instrument, with coding of the connections. However, it is also possible, as shown in FIG. 5, to place two frame parts 1 being mirror images of each other, and frictionally hold them together by the contact plates 5. If a screw is introduced into opening 6, assembled connecting elements are provided as shown in FIG. 5. This assembly constitutes a connection plug element in accordance with the present invention, which can be utilized, for example, on intermediate partitions or on connection walls such as in switch panels or the like.

Figure 7:
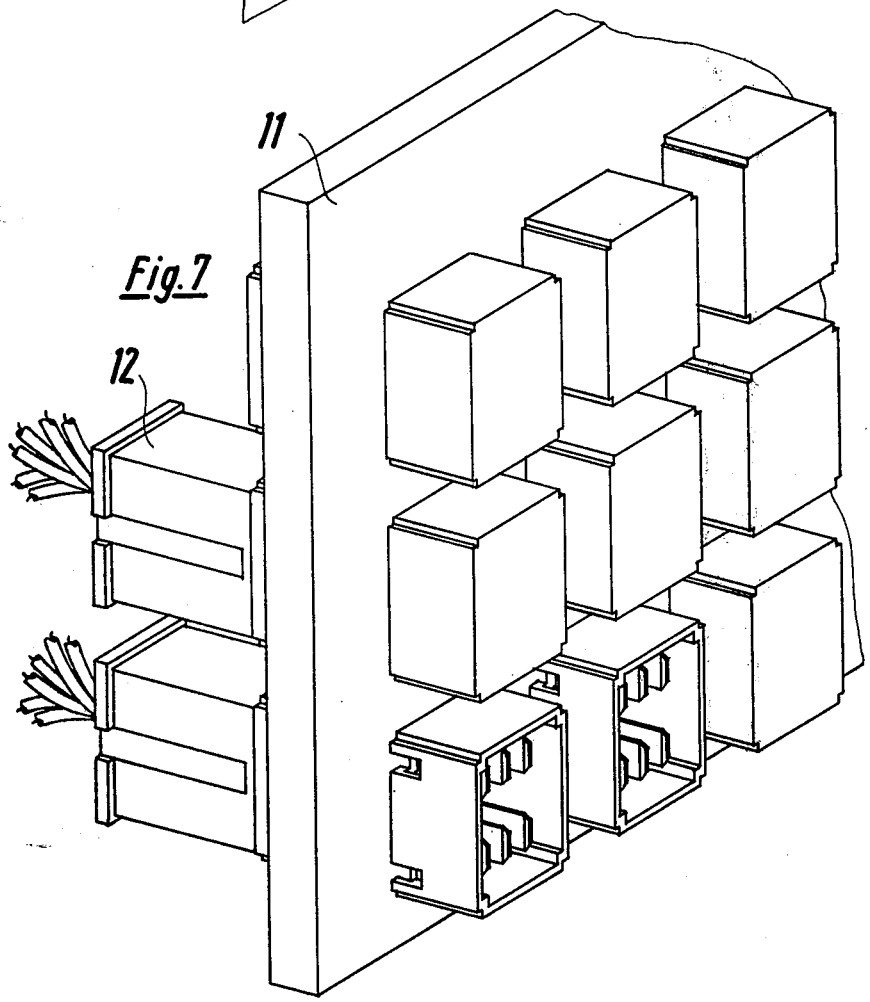
FIG. 7 shows several connection elements in accordance with the present invention arranged on a partition and in connection with socket plug-in parts.

Another arrangement for use is shown in FIG. 7. The advantage of this arrangement consists in that a plurality of the assembled connecting plug elements of FIG. 1 can be disposed on a partition 11 or the like, which may also be part of a frame, in association with connectors 12 connecting electrical conductors to each of the individual connection elements 1, 1. The sockets 13 of the plugs 12 similarly are made with openings 14, as seen in FIG. 5, which enable selective arrangement of flat sockets, either horizontally or vertically, relative to the arrangement of the contact plates 5. Each socket can thus be adapted to an associated connection plug element and can only be plugged to it.

It is also possible to make connectors 12 in such a way that all openings 14 are made only as vertical slots so that the associated plates 5 also have to be set vertically. Coding could then be effected by making the middle three fields 12A of connector 12 as coding plug openings whose special pins, which are not illustrated and which would be used only for coding, are disposed on frame 1. Coding possibilities are somewhat limited of course, but they are sufficient in many cases.

Figure 8:
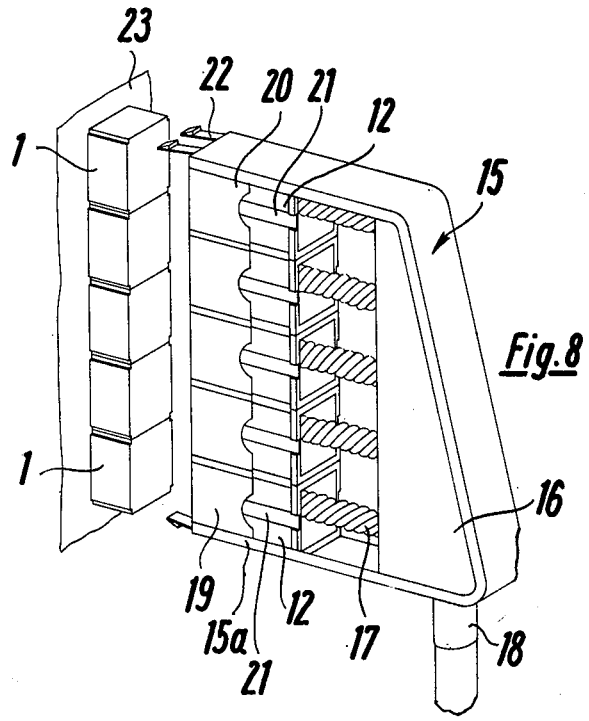
FIG. 8 shows several socket plug-in elements assembled by hand to form a unit which cooperate with a number of connection plug elements in accordance with the present invention.

Another advantageous arrangement is shown in FIG. 8, where five connection elements 1 are disposed on a switch panel holder 23 or the like at standard distances one below the other or adjacent to each other. These five connection elements, in which the arrangement of the contact plates is not individually shown, have associated with them five connector elements 12 arranged in a retaining frame 15 which substantially comprises a metallic part bent in a U-shaped, and provided on the arcuate part of the U with a holder 16 made as a hand grip, such as similarly described in my co-pending application, Ser. No. 793,247, filed concurrently herewith. Inside holder 16 there is a cavity for holding together the individual wound cable connections 17 that come from the respective connector elements 12 and then joined to a common lead 18. The two arms 15*a* of U-shaped frame 15 are interconnected by a lateral cross strip 19 that presents a lateral slide guide 20 in the form of guide walls for each of the five connector elements 12. Projecting ribs are (not visible in the drawing) on the inside of side walls 20, which engage in recesses 21 on the parallel side walls of connector elements 12, and thus constitute a guide for the individual connector elements 12 which can respectively be inserted parallel to arms 15*a* of arcuate frame 15. Arcuate frame 15 also includes retaining clips 22 on its upper and lower ends to attach like an insert grip the frame, (not shown in detail) to the panel holder 23 that receives connection element 1.

The connections can be established by simple pressing-in of connector elements 12 into the contact plates of the plug-in elements 1. Connector elements 12 are accessible from the side of the U-shaped member 15 and can be pushed-in from the front of elements 1.

The slide guide construction is advantageous because it has been found that in the pushing-in of the connector onto as many as six or eight contact plates of the elemnts 1, the friction forces that have to be overcome are so great that the connection of five connector elements by hand would be very difficult, especially if the individual contact plates have a length of about 5 or 6 mm and a thickness of 1 mm, as needed for most connections. There is no difficult at all in making the connection though because of the mobility of the individual connector elements. It is impossible to confuse the connector elements, and in this way the assembling is very simple.

Both arcuate frame 15 with the connector elements 12 therein, and connection plug elements 1 in the panel holder 23 can be prefabricated at a manufacturing plant, even in larger units, so that when they are received and put into operation only individual arcuate frame units 15 have to be plugged in. These units 15 can be numbered so that there is no trouble in making even a great number of connections rapidly, and without any risk of false connections.

While I have shown and described several embodiments in accordance with the present invention, it is understood that the same is not limited thereto but is susceptible of numerous changes and modifications as known to a person skilled in the art, and I therefore do no wish to be limited to the details shown and described herein but intend to cover all such changes and modifications as are obvious to one of ordinary skill in the art.

I claim:

1. In a connection element for electrical connections of the type comprising a frame structure, a plurality of guide openings in said frame structure, and a plurality of contact plates, each being inserted into a respective one of said guide openings to be mounted in said frame structure, the improvement comprising said guide openings including slotted openings with at least one of said slotted openings having mutually perpendicular grooves to selectively arrange one of said contact plates in one of two perpendicular positions in accordance with a preselected coding.

2. A connection element according to claim 1, wherein a plurality of said slotted openings having said mutually perpendicular grooves are arranged in at least one of rows and columns.

3. A connection element according to claim 2, wherein said mutually perpendicular grooves of said rows and columns are respectively parallel to one another, and wherein at least one row of coding plug opening for cooperation with contactless pins is provided for coding plug-in connections.

4. A connection element for electrical connections comprising a plurality of contact plates being connectable with connection means, said contact plates being flat plates symmetrical with reference to a midplane and having a central portion with a flat width greater than the width of the remaining portion of said flat plates, retaining means for mounting said plurality of contact plates, said retaining means including a frame member having an edge portion surrounding said contact plates at one side and insertion guide means for guiding said contact plates thrust-into said frame member at the opposite side to said edge portion, said insertion guide means having stop means cooperating with said central portion of said contact plates for stopping said contact plates with said central portion extending halfway into said insertion guide means, and said insertion guide means including passage means being pairs of oppositely associated grooves for engaging said contact plates, said pairs of grooves of at least one insertion guide means being mutually perpendicular to selectively thrust one of said contact plates into one or the other pairs of grooves in accordance with a preselected positioning of said one contact plate in said one insertion guide means.

5. A connection element as in claim 4, characterized in that a plurality of said insertion guide means include said pairs of grooves which are disposed in at least one of rows or columns.

6. A connection element as in claim 5, characterized in that three pairs of grooves are respectively disposed in respective rows and columns.

7. A connection element as in claim 4, characterized in that frame members are provided in mirror-image pairs.

8. A connection element as in claim 4, characterized in that frame members are combined as structural units in rows adjacent to each other and one below the other.

9. A connection element as in claim 4, characterized in that an analogously constructed plug-in socket means is associated with respective frame members.

10. A connection element as in claim 9, characterized in that the plug-in socket means are combined in a plurality of structural units.

11. A connection element as in claim 4, characterized in that a plurality of said insertion guide means include pairs of said grooves parallel to each other, and disposed in a matrix of rows adjacent to each other and one below the other, and in that at least one row of field means is provided for special coding plug openings with contactless pins cooperating therewith for coding plug-in connections.

12. A connection element as in claim 11, characterized in that three rows of field means are provided on each frame means, and in that the middle row is provided with coding insertion openings.

* * * * *